US009033440B2

(12) United States Patent
Sano

(10) Patent No.: US 9,033,440 B2
(45) Date of Patent: May 19, 2015

(54) RECORDING APPARATUS

(71) Applicant: BROTHER KOGYO KABUSHIKI KAISHA, Nagoya-shi, Aichi-ken (JP)

(72) Inventor: Toshiyuki Sano, Aichi-ken (JP)

(73) Assignee: BROTHER KOGYO KABUSHIKI KAISHA, Nagoya-Shi, Aichi-Ken (JP)

( * ) Notice: Subject to any disclaimer, the term of this patent is extended or adjusted under 35 U.S.C. 154(b) by 0 days.

(21) Appl. No.: 13/851,790

(22) Filed: Mar. 27, 2013

(65) Prior Publication Data

US 2013/0321508 A1 Dec. 5, 2013

(30) Foreign Application Priority Data

May 31, 2012 (JP) ..... 2012-125482

(51) Int. Cl.
*B41J 29/38* (2006.01)
*B41J 13/00* (2006.01)
*B41J 13/10* (2006.01)

(52) U.S. Cl.
CPC ..... *B41J 13/0009* (2013.01); *B41J 13/0036* (2013.01); *B41J 13/106* (2013.01)

(58) Field of Classification Search
USPC ..... 347/9, 14, 19, 5, 16
See application file for complete search history.

(56) References Cited

U.S. PATENT DOCUMENTS 5,181,705 A 1/1993 Ueda et al.
7,819,491 B2 * 10/2010 Nishimura ..... 347/9

FOREIGN PATENT DOCUMENTS

JP H01-321249 A 12/1989
JP H08-324051 A 12/1996
JP 2006-168877 A 6/2006
JP 2009-214977 A 9/2009

* cited by examiner

*Primary Examiner* — Lam Nguyen
(74) *Attorney, Agent, or Firm* — Merchant & Gould PC

(57) ABSTRACT

A recording apparatus, including: a recording portion configured to record an image on each of recording media; a stack portion on which image-recorded recording media are stacked; a conveyor portion configured to convey each recording medium from a recording position at which the image is recorded toward the stack portion; and a controller configured to control the recording apparatus, wherein the controller is configured to control the conveyor portion such that, where two mutually opposable surfaces of two successive recording media that are to be successively stacked on the stack portion are both image-recorded surfaces on each of which an image has been recorded, a movement speed, when stacked, of one of the two successive recording media that is to be later stacked on the stack portion is made smaller, as compared with an instance where at least one of the two mutually opposable surfaces is not the image-recorded surface.

11 Claims, 10 Drawing Sheets

RECORDING APPARATUS

CROSS REFERENCE TO RELATED APPLICATION

The present application claims priority from Japanese Patent Application No. 2012-125482, which was filed on May 31, 2012, the disclosure of which is herein incorporated by reference in its entirety.

BACKGROUND

1. Field of the Invention

The present invention relates to a recording apparatus configured to record an image on a recording medium.

2. Description of Related Art

There is known a technique of reducing a conveyance speed of a recording medium where a water content of the recording medium is large, for the purpose of ensuring improved alignment of recording media on a receiving tray (output tray) configured to receive discharged recording media in a recording apparatus.

SUMMARY

In the known technique, attention is directed to the water content of the recording medium to ensure proper alignment of recording media stacked on the receiving tray (stack portion). The inventor of the present invention has found that poor alignment of the recording media is caused even if the water content of each recording medium is reduced after a lapse of time in the case of duplex recording, for instance.

It is therefore an object of the invention to provide a recording apparatus in which it is possible to prevent, from the viewpoint different from the water content, deterioration in alignment of the recording media stacked on the stack portion.

The object indicated above may be attained according to a principle of the present invention, which provides a recording apparatus, including:

a recording portion configured to perform a recording operation to record an image on each of recording media;

a stack portion on which the recording media on each of which the image has been recorded by the recording portion are stacked;

a conveyor portion configured to convey each of the recording media from a recording position at which the image is recorded on said each of the recording media by the recording portion toward the stack portion; and a controller configured to control the recording apparatus, wherein the controller is configured to control the conveyor portion such that, in an instance where two mutually opposable surfaces of two successive recording media among the recording media that are to be successively stacked on the stack portion are both image-recorded surfaces on each of which an image has been recorded, a movement speed, when stacked, of one of the two successive recording media that is to be later stacked on the stack portion is made smaller, as compared with an instance where at least one of the two mutually opposable surfaces is not the image-recorded surface.

BRIEF DESCRIPTION OF THE DRAWINGS

The above and other objects, features, advantages and technical and industrial significance of the present invention will be better understood by reading the following detailed description of embodiments of the invention, when considered in connection with the accompanying drawings, in which.

DETAILED DESCRIPTION OF THE EMBODIMENTS

There will be explained embodiments of the present invention with reference to the drawings.

Figure 1:
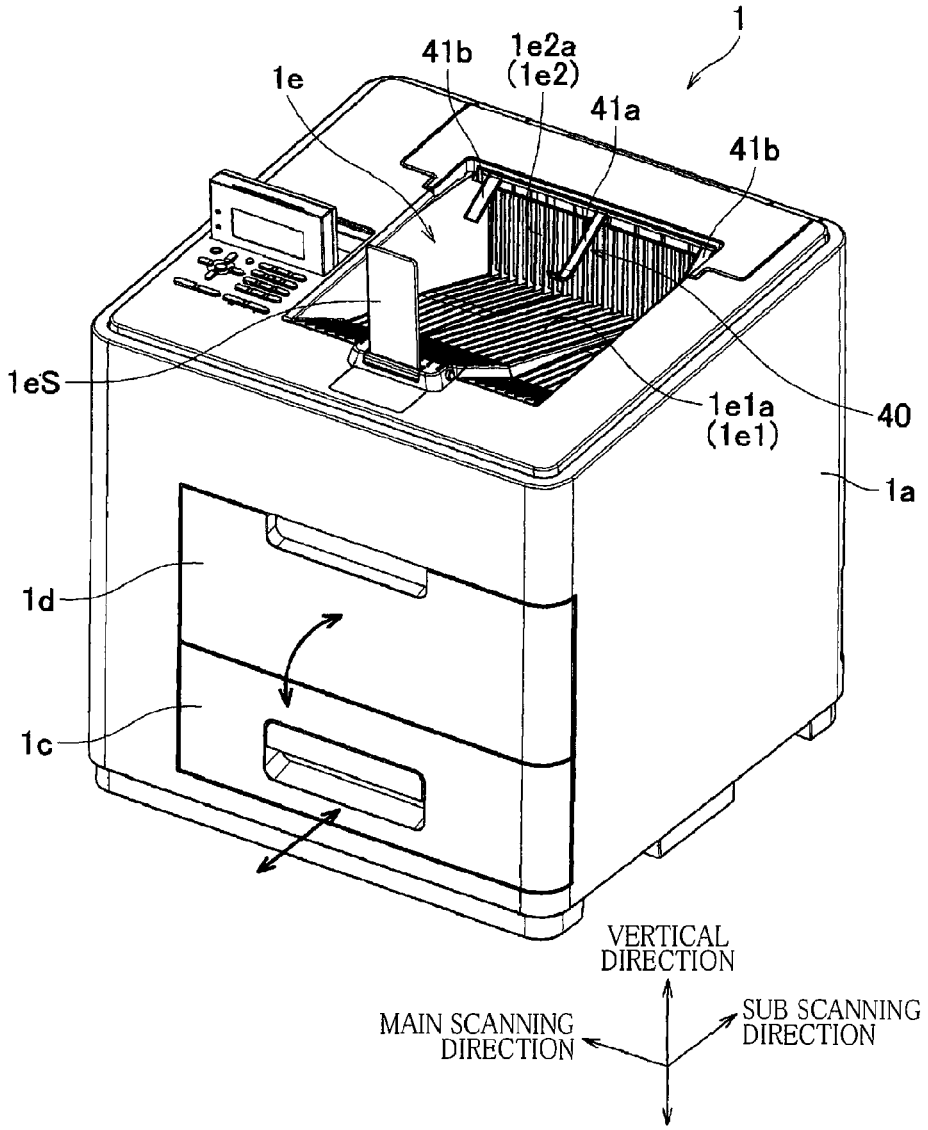
FIG. 1 is an external perspective view showing an ink-jet printer according to a first embodiment of the invention.
Figure 2:
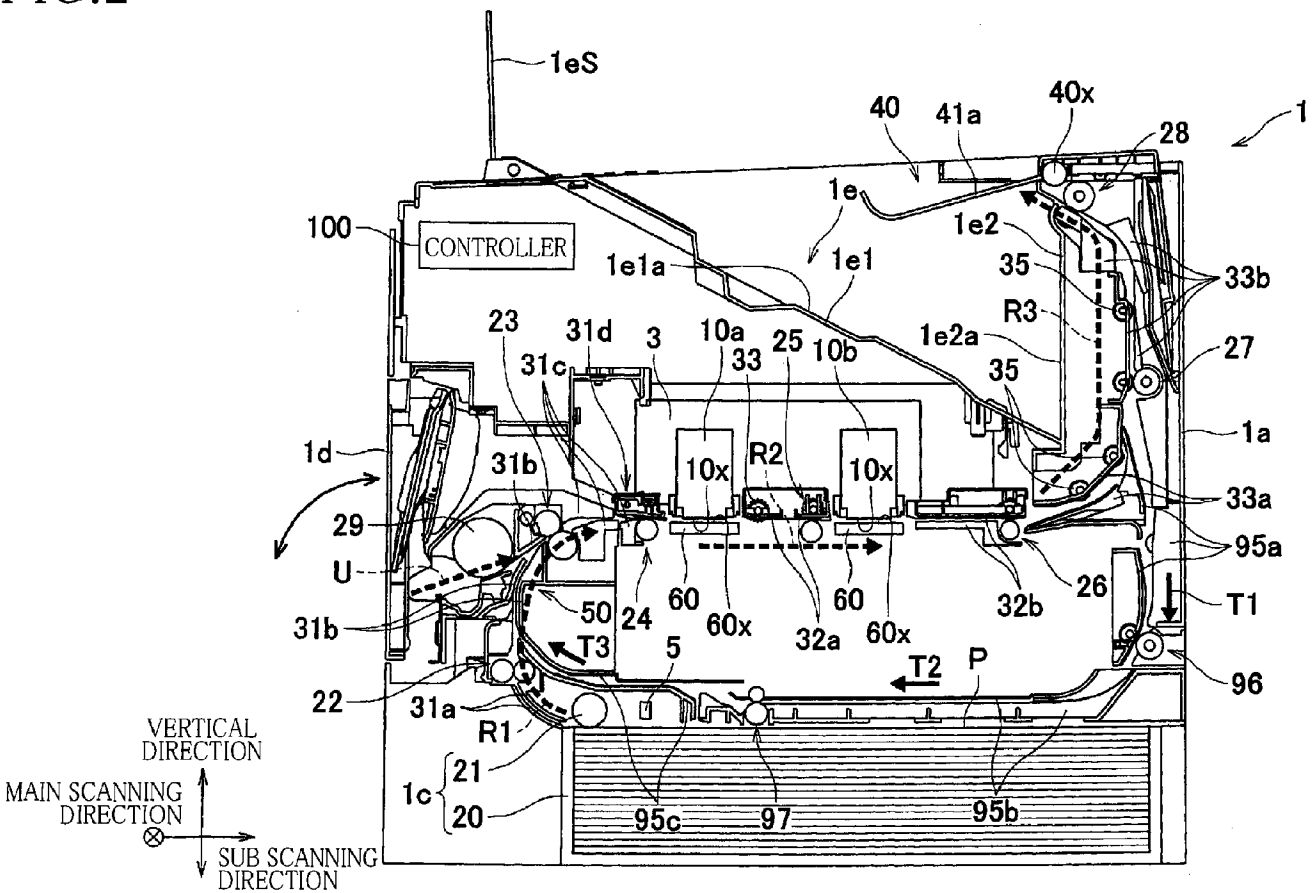
FIG. 2 is a schematic side view showing an inside of the printer.

Referring first to FIGS. 1 and 2, there will be explained an overall structure of an ink-jet printer according to a first embodiment of the present invention.

The printer generally indicated at 1 in FIGS. 1 and 2 has a casing 1*a* having a rectangular parallelepiped shape. A stack portion le is provided on a top plate of the casing 1*a*. On a front side of the casing 1*a* (i.e., a front left face thereof in the sheet of FIG. 1 or a left face thereof in the sheet of FIG. 2), a manual feeding tray 1*d* is attached so as to be openable and closable. In an internal space of the casing 1*a*, there are accommodated a controller 100, two heads 10*a*, 10*b* each configured to perform a recording operation, two platens 60, a conveyor portion 50, and a sheet supply unit 1*c*. In the internal space of the casing 1*a*, there is formed a conveyance passage in which a sheet P, as a recording medium, is conveyed from the sheet supply unit 1*c* to the stack portion 1*e*, as indicated by a bold arrow in a dashed line in FIG. 2.

Further, in the casing 1*a*, there are removably provided a cartridge (not shown) that stores a pre-treatment liquid to be supplied to the head 10*a* and a cartridge (not shown) that stores black ink to be supplied to the head 10*b*. The pre-treatment liquid has a function to prevent ink spreading and ink strikethrough, a function of improving color developing property and quick-drying property of ink, etc. Hereinafter, the pre-treatment liquid and the black ink may be collectively referred to as "liquid" where appropriate. The liquid is one example of a recording agent. Each of the cartridges is connected to a corresponding one of the heads 10*a*, 10*b* via a tube or the like so as to supply the liquid to the corresponding one of the heads 10*a*, 10*b*.

The heads 10*a*, 10*b*, each as a main constituent element of a recording portion, has the same structure. Each of the heads 10*a*, 10*b* is a line head having a generally rectangular parallelepiped shape that is long in a main scanning direction. Each of the heads 10*a*, 10*b* has a lower surface functioning as an ejection surface 10*x* in which a plurality of ejection openings are open. In each of the heads 10*a*, 10*b*, there are formed channels through which the liquid supplied from the corresponding cartridge flows to the ejection openings. The heads 10*a*, 10*b* are spaced apart from each other in a sub scanning direction and are supported by the casing 1*a* through a holder 3. The holder 3 holds the heads 10*a*, 10*b* such that a suitable clearance is formed between the ejection surface 10*x* of each head 10, 10*b* and an upper surface 60*x* of the corresponding platen 60. Here, the sub scanning direction is a direction parallel to a direction in which the sheet P is conveyed by the conveyor portion 50 (hereinafter referred to as "conveyance direction" where appropriate), and the main scanning direction is a direction orthogonal to the sub scanning direction and along the horizontal plane.

The platens 60 are provided for the respective heads 10*a*, 10*b*. Each platen 60 is a flat plate member and is disposed at a position at which the platen 60 is opposed to the corresponding ejection surface 10*x* in the vertical direction.

The sheet supply unit 1*c* includes a sheet tray 20 and a sheet supply roller 21. The sheet tray 20 is attachable to and detachable from the casing la in the sub scanning direction. The sheet tray 20 is a box opening upward and is capable accommodating a plurality of sheets P. The sheet supply roller 21 is configured to rotate by being driven by a sheet supply motor 1*c*M (FIG. 5) under the control of the controller 100, thereby supplying the uppermost one of the sheets P accommodated in the sheet tray 20.

A scanner 5 as one example of an image reading portion is provided in the vicinity of the sheet supply roller 21. The scanner 5 is constituted by a Charge Coupled Device (CCD), a Contact Image Sensor (CIS) or the like and is configured to read an image on a back surface of the sheet P. The back surface is a surface of the sheet P that faces upward in a state in which the sheet P is accommodated in the sheet tray 20.

Figure 5:
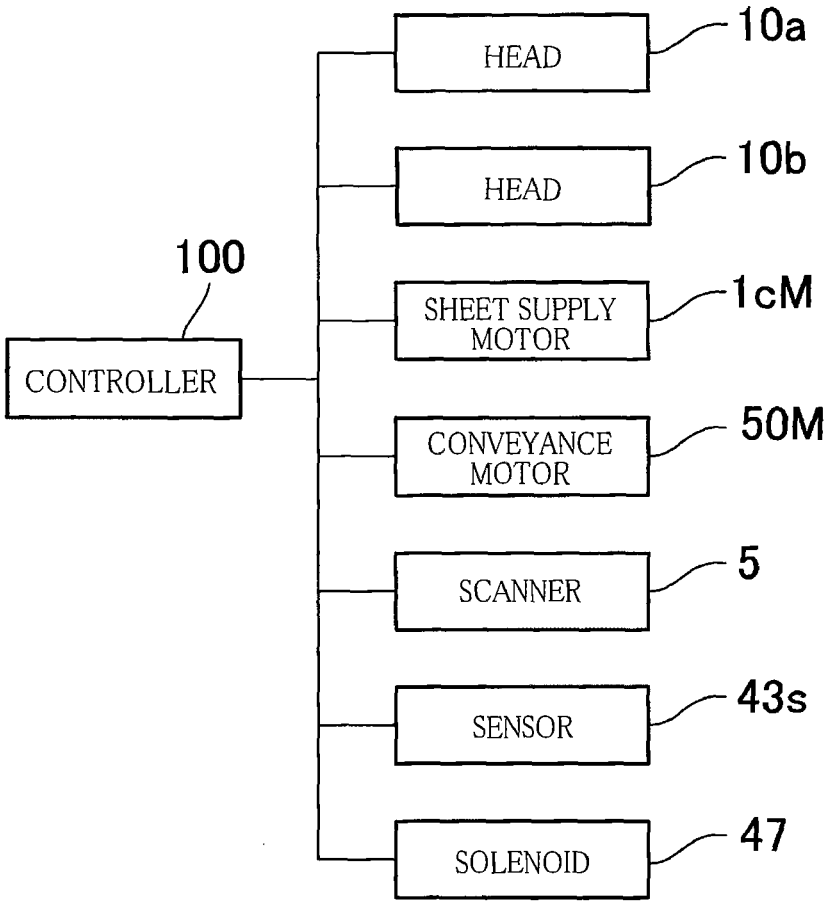
FIG. 5 is a block diagram showing an electric structure of the printer.

The conveyor portion 50 defines a passage in which the sheet P is conveyed. The passage includes a passage R1, a passage R2, and a passage R3 relating to ordinary conveyance, a passage T1, a passage T2, and a passage T3 relating to re-conveyance, and a passage U relating to conveyance for manual feeding. The conveyor portion 50 includes the following constituent components that define the passages R1-R3, T1-T3, U and a conveyance motor 50M (FIG. 5).

Figure 3A:
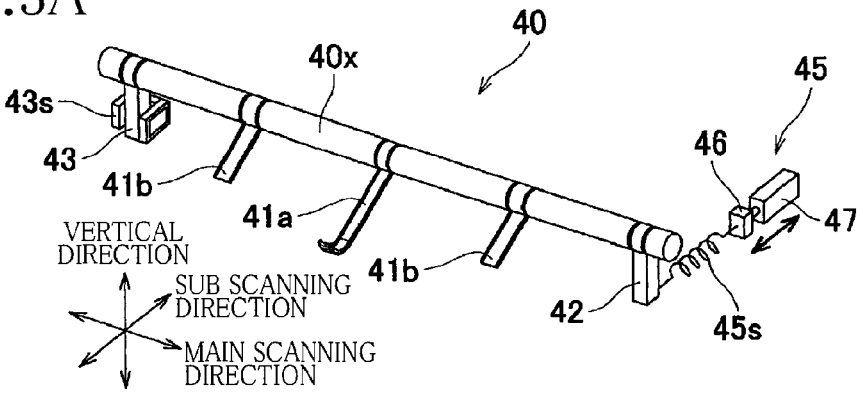
FIG. 3A is a perspective view showing a pressing member.

The passage R1 is a U-like curved passage as viewed in the main scanning direction and extends from the sheet supply unit 1*c* toward recording positions below the respective ejection surfaces 10*x*. The passage R1 is defined by a guide 31*a*, a roller pair 22, a guide 31*b*, a roller pair 23, a guide 31*c*, a guide 31*d*, and a roller pair 24. The passage R2 passes through the recording positions of the respective two heads 10*a*, 10*b* and is defined by a guide 32*a*, a pressure roller 33, and a roller pair 25. The passage R3 is a U-like curved passage as viewed in the main scanning direction and extends from the recording positions to the stack portion le. The passage R3 is defined by a guide 32*b*, a guide 33*a*, a guide 33*b*, a pressure roller 35, a roller pair 26, a roller pair 27, roller pair 28, a pressing member 40, and a pressing-force changer 45 (FIG. 3A). The passages R1-R3 have a reverse S-like shape as a whole.

The passage T1 extends downward in the vertical direction and is defined by a guide 95*a* and a roller pair 96. The passage T2 extends in a direction opposite to the passage R2 and is defined by a guide 95*b* and a roller pair 97. The passage T3 extends obliquely upward toward an intermediate portion of the passage R1 and is defined by a guide 95*c*.

The passage U extends from the manual feeding tray 1*d* to the intermediate portion of the passage R 1 and is defined by a roller 29.

Each of the guides 31*a*-31*d*, 32*a*, 32*b*, 33*a*, 33*b*, 95*a*-95*c* is a member having a guide surface for guiding the sheet P. Each of the roller pairs 22-28, 96, 97 is constituted by a drive roller configured to rotate by being driven by the conveyance motor 50M under the control of the controller 100 and a driven roller configured to rotate in association with the rotation of the drive roller. The roller 29 is a drive roller configured to rotate by being driven by the conveyance motor 50M under the control of the controller 100.

The sheet P supplied from the sheet tray 20 under the control of the controller 100 initially passes the passages R1, R2. In the passage R2, the sheet P sequentially passes right below the respective heads 10*a*, 10*b*, namely, the sheet P sequentially passes the respective recording positions, while being supported on the upper surfaces 60*x* of the respective platens 60. On this occasion, the heads 10*a*, 10*b* are driven so as to eject the liquid from the ejection openings thereof toward a front surface of the sheet P, so that an image is recorded on the front surface of the sheet P. In the case of single-sided recording in which an image is formed only on the front surface of the sheet P, the sheet P subsequently passes the passage R3 and is finally stacked on the stack portion 1*e*. In the case of duplex recording in which an image is recorded on both of the front surface and the back surface of the sheet P, the sheet P existing in the passage R3 with its trailing end portion (the upstream-side end portion of the sheet P in the conveyance direction) nipped by the rollers of the roller pair 28 travels toward the passage T1 by reversing the rotational direction of the rollers of the respective roller pairs 27, 28. Thereafter, the sheet P is fed into the intermediate portion of the passage R1 after having passed the passages T1-T3, and an image is recorded on the back surface of the sheet when the sheet P again passes the passage R2. Then the sheet P passes the passage R3 and is finally stacked on the stack portion le. Where the sheet P is fed from the manual feeding tray 1*d*, the sheet P reaches the intermediate portion of the passage R1 after having passed the passage U. Thereafter, as described above, an image is similarly recorded on the front surface of the sheet P in the passage R2, and the sheet P is finally stacked on the stack portion le after having passed the passages in accordance with the single-sided recording or the duplex recording.

The front surface of the sheet P is a surface thereof facing downward in the sheet tray 20 while the back surface of the sheet P is a surface thereof facing upward in the sheet tray 20. Where the sheet P is fed from the manual feeding tray 1*d*, the front surface of the sheet P is a surface thereof facing upward in the manual feeding tray 1*d* while the back surface of the sheet P is a surface thereof facing downward in the manual feeding tray 1*d*.

The stack portion le includes an inclined member 1*e*1, a vertical member 1*e*2, and a stopper 1*e*S.

The inclined member 1*e*1 is provided by the upper wall of the casing 1*a* and includes an inclined surface 1*e*1*a* that is inclined relative to the horizontal plane. The inclined surface 1*e*1*a* is formed such that the height of the inclined surface 1*e*1*a* as measured from the horizontal plane increases toward a downstream side in a movement direction of the sheet P (i.e., in the leftward direction in FIG. 2) in which the sheet P moves when stacked on the stack portion 1*e*.

The vertical member 1*e*2 extends in the vertical direction on an upstream side of the inclined surface 1*e*1*a* in the above-indicated movement direction. The vertical member 1*e*2 has a support surface 2*e*2*a* to support the trailing end portion of the sheet P. A rear surface of the vertical member 1*e*2, i.e., a surface of the vertical member 1*e*2 opposite to the support surface 1*e*2*a*, partially constitutes the guides 33*a*, 33*b*.

The stopper 1*e*S is a rectangular plate and stands upright on the downstream side of the inclined surface 1*e*1*a* in the above-indicated movement direction, such that opposite major surfaces of the stopper 1*e*S have a certain length in the vertical direction and a certain width in the main scanning direction. The stopper 1*e*S has a function of preventing the sheet P from moving out of the inclined surface 1*e*1*a* when stacked on the stack portion 1*e*.

The controller 100 includes a Central Processing Unit (CPU) as a processing unit, a Read Only Memory (ROM), a Random Access Memory (RAM) including a non-volatile RAM, an Application Specific Integrated Circuit (ASIC), an Interface (I/F), an Input/Output Port (I/O), and so on. The ROM stores therein programs to be executed by the CPU, various fixed data, and so on. The RAM temporarily stores therein data (image data and the like) necessary for execution of the programs. The ASIC performs rewriting, sorting, and so on, of the image data, such as signal processing and image processing. The I/F transmits and receives data to and from an external device such as a personal computer (PC) connected to the printer 1. The I/O inputs and outputs detection signals of various sensors. In this regard, the controller 100 may be configured not to include the ASIC, and the rewriting and sorting of the image data may be executed by programs or the like executed by the CPU.

Referring next to FIGS. 3A-C and 4A-D, the structures of the pressing member 40 and the pressing-force changer 45 will be explained. The pressing member 40 is configured to press, toward the stack portion le, the sheet P that is being conveyed by the roller pair 28 disposed on the most downstream side in the conveyance direction among the plurality of roller pairs. The pressing-force changer 45 is configured to change a pressing force to be applied to the sheet P from the pressing member 40.

As shown in FIG. 3A, the pressing member 40 includes a shaft 40*x*, a first arm 41*a*, a pair of auxiliary arms 41*b*, a second arm 42, and a third arm 43. The shaft 40*x* has a cylindrical shape and extends in the main scanning direction. Each of the arms 41*a*, 41*b*, 42, 43 is an elongate plate member having a certain width in the main scanning direction and protrudes from the shaft 40*x*. In association with rotation of the shaft 40*x*, the arms 41*a*, 41*b*, 42, 43 pivot together about the axis of the shaft 40*x*.

The first arm 41*a* is disposed at a central portion of the shaft 40*x* in the main scanning direction. The pair of auxiliary arms 41*b* is disposed such that one of the two auxiliary arms 41*b* is disposed at a position that is distant from the central portion of the shaft 40*x* toward one end of the shaft 40*x* in the main scanning direction and the other of the two auxiliary arms 41*b* is disposed at a position that is distant from the central portion of the shaft 40*x* toward the other end of the shaft 40*x* in the main scanning direction. The second arm 42 and the third arm 43 are respectively disposed near to the one end and the other end of the shaft 40*x* in the main scanning direction.

The first arm 41*a* and the pair of auxiliary arms 41*b* protrude from the shaft 40*x* in the same direction. The second arm 42 and the third arm 43 protrude from the shaft 40*x* in the same direction. The direction of protrusion of the first arm 41*a* and the pair of auxiliary arms 41*b* from the shaft 40*x* differs from the direction of protrusion of the second arm 42 and the third arm 43 from the shaft 40*x*.

In the arms 41*a*, 41*b*, 42, 43, the first arm 41*a* has the longest length of protrusion from the shaft 40*x*, the auxiliary arms 41*b* has the second longest length of protrusion, and the second arm 42 and the third arm 43 have the shortest length of protrusion. The two auxiliary arms 41*b* have the same length of protrusion from the shaft 40*x*, and the second arm 42 and the third arm 43 have the same length of protrusion from the shaft 40*x*. The first arm 41*a* has a distal end (that is opposite to its proximal end fixed to the shaft 40*x*) that is curved upward.

In the arms 41*a*, 41*b*, 42, 43, the first arm 41*a* and the pair of auxiliary arms 41*b* are configured to come into contact with the sheet P that is being conveyed by the roller pair 28. The two auxiliary arms 41*b* are configured to come into contact with one and the other of widthwise opposite end portions of the sheet P and have a function of correcting a curl of the sheet P. A sensor 43*s* is attached to the third arm 43.

Figure 3B:
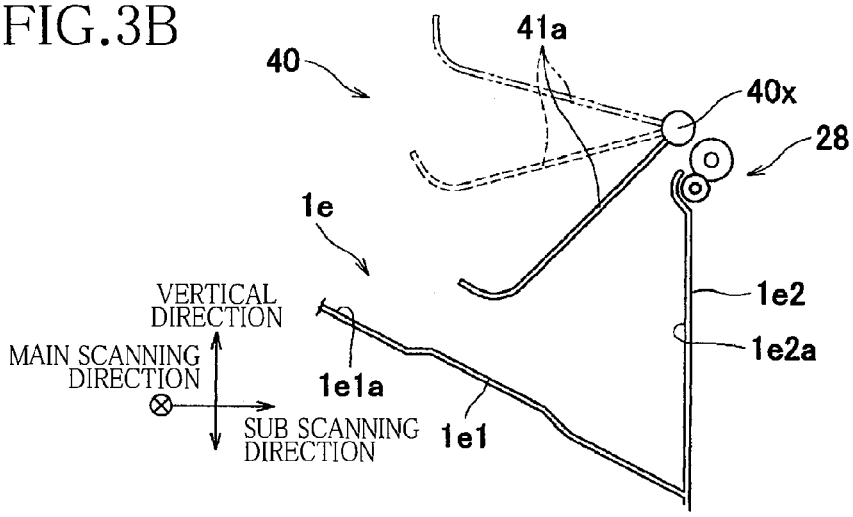
FIG. 3B is a schematic side view showing positions at which a first arm is locatable.
Figure 3C:
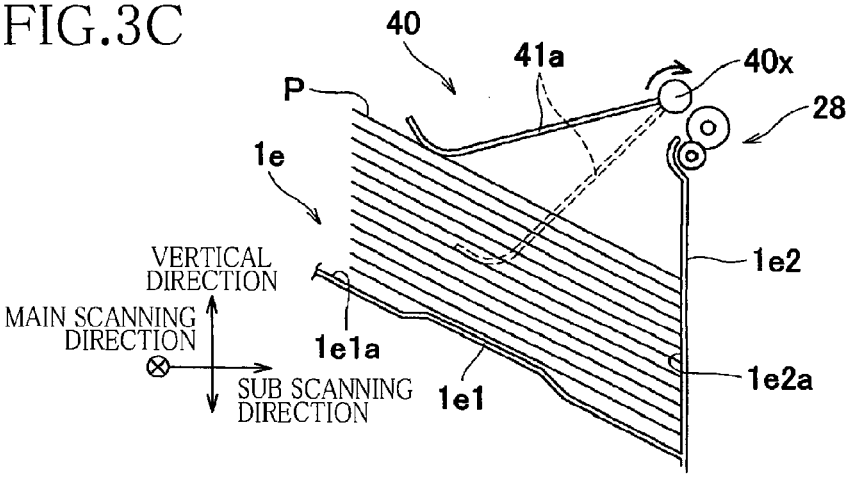
FIG. 3C is a schematic side view showing a state in which the first arm pivots in accordance with an amount of sheets stacked on a stack portion.

The first arm 41*a* is configured to be selectively placed by pivoting at one of a first position (indicated by the solid line in FIG. 3B); a second position (indicated by the dashed line in FIG. 3B); and a third position (indicated by the long dashed double-short dashed line in FIG. 3B). To be more specific, the first arm 41*a* is placed at the first position when no external force acts thereon, namely, when the first arm 41*a* is in contact with neither any sheet P on the inclined surface 1*e*1*a* nor the sheet P that is being conveyed by the roller pair 28. As shown in FIG. 3C, the first arm 41*a* pivots in accordance with an amount of the sheets P stacked on the stack portion 1*e* and comes into contact with the uppermost sheet P on the inclined surface 1*e*1*a*. The first arm 41*a* is placed at the second position when the sheets P in a maximum amount are stacked on the stack portion 1*e*. The first arm 41*a* is placed at the third position when the first arm 41*a* is lifted up by the sheet P that is being conveyed by the roller pair 28. As for the height levels, in the vertical direction, of the first through third positions, the first position is the lowest while the third position is the highest. The second position is between the first position and the third position in the vertical direction. The distal end of the first arm 41*a* is located at its lowest position when the first arm 41*a* is placed at the first position and is located at its highest position when the first arm 41*a* is placed at the third position. It is noted that the third position may be lower than the second position.

The sensor 43*s* includes a light emitting portion and a light receiving portion that is disposed so as to be opposed to the light emitting portion. The sensor 43*s* is configured to output, to the controller 100, an ON signal when the light receiving portion receives a light emitted by the light emitting portion and to output, to the controller 100, an OFF signal when the light receiving portion does not receive a light emitted by the light emitting portion. When the first arm 41*a* is located at the first position, the light emitted by the light emitting portion is blocked by the third arm 43 and accordingly the light is not received by the light receiving portion. Therefore, the sensor 43*s* outputs the OFF signal. When the first arm 41*a* is located at the second position, the light emitted by the light emitting portion is received by the light receiving portion without being blocked by the third arm 43. Therefore, the sensor 43*s* outputs the ON signal. The controller 100 judges that the sheets P in the maximum amount have been stacked on the stack portion 1*e* where the controller 100 receives the ON signal from the sensor 43*s* for a time period not shorter than a prescribed time period. It is noted that the ON signal is outputted from the sensor 43*s* when the first arm 41*a* passes the second position during its movement from the first position to the third position via the second position. However, a time period during which the ON signal is outputted from the sensor 43*s* on this occasion is shorter than the above-indicated prescribed time period. Accordingly, the controller 100 does not judge that the sheets P in the maximum amount have been stacked on the stack portion 1*e*.

Figure 4A:
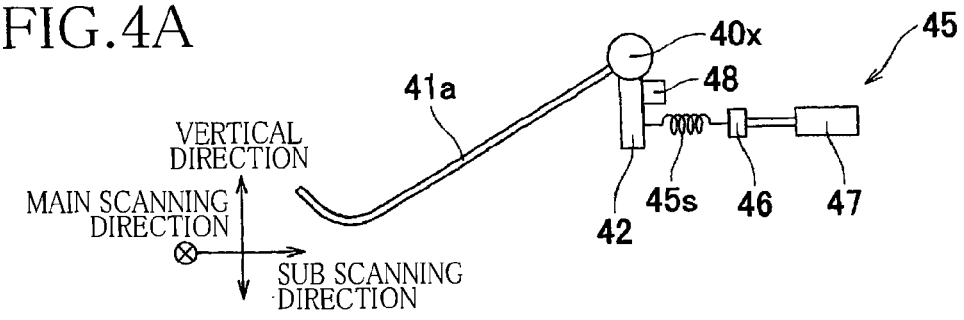
FIG. 4A is a schematic side view showing a state in which a pressing-force changer is in a first state and the first arm is located at a first position.

As shown in FIG. 4A, the pressing-force changer 45 includes a spring 45*s*, a support member 46, a solenoid 47 as one example of a distance change mechanism, and a stopper 48. The stopper 48 is disposed in the vicinity of the shaft 40*x*. The stopper 48 is for inhibiting a movement of the second arm 42 such that the second arm 42 does not pivot counterclockwise in FIGS. 4A, 4B about the shaft 40*x* from the state in which the second arm 42 extends downward from the shaft 40*x*. The spring 45*s* is fixed at one end thereof to the second arm 42 and at the other end thereof to the support member 46. When the spring 45*s* is expanded, the spring 45*s* applies, to the arms 41*a*, 41*b*, 42, 43, a force in a direction in which the arms 41*a*, 41*b*, 42, 43 pivot counterclockwise in FIGS. 4A, 4B about the shaft 40*x*. The support member 46 supports the other end of the spring 45*s* and is connected to the second arm 42 through the spring 45*s*. A plunger of the solenoid 47 is fixed to one surface of the support member 46 that is opposite to another surface of the support member 46 to which the spring 45*s* is fixed. When the plunger is advanced by being driven by the solenoid 47, a distance between the support member 46 and the second arm 42 is changed.

Figure 4B:
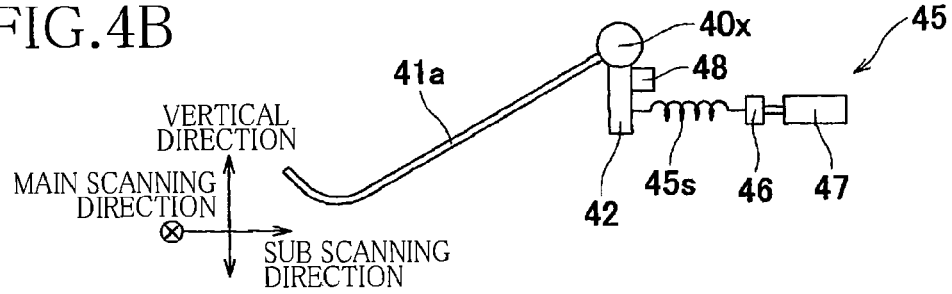
FIG. 4B is a schematic side view showing a state in which the pressing-force changer is in a second state and the first arm is located at the first position.

The pressing-force changer 45 is configured to be selectively placed, in accordance with the driving by the solenoid 47, in one of a first state (shown in FIG. 4A); and a second state (shown in FIG. 4B). The pressing-force changer 45 is placed in the first state when the solenoid 47 is being advanced while the pressing-force changer 45 is placed in the second state when the plunger of the solenoid 47 is retracted.

Both of when the pressing-force changer 45 is in the first state and when the pressing-force changer 45 is in the second state, the arms 41*a*, 41*b*, 42, 43 tend to pivot counterclockwise about the shaft 40*x* owing to the force of the spring 45*s*. When the first arm 41*a* is located at the first position and the pressing-force changer 45 is in the first state or the second state, however, the stopper 48 contacts the second arm 42 and thereby inhibiting the second arm 42 from moving, as shown in FIGS. 4A, 4B. Therefore, the first arm 41*a* is kept located at the first position and is prevented from pivoting counterclockwise about the shaft 40*x* beyond the first position. In other words, the first arm 41*a* is kept located at the first position owing to the force of the spring 45*s* and the movement inhibiting function by the stopper 48.

The distance between the support member 46 and the second arm 42 is larger and the spring 45*s* is more expanded when the pressing-force changer 45 is in the second state than when the pressing-force changer 45 is in the first state. Accordingly, the force of the spring 45*s* is larger when the pressing-force changer 45 is in the second state, so that the pressing force applied to the sheet P by the first arm 41*a* and the pair of auxiliary arms 41*b* is larger. Hence, a frictional force between: the first arm 41*a* and the pair of auxiliary arms 41*b;* and the sheet P is lager when the pressing-force changer 45 is in the second state than when the pressing-force changer 45 is in the first state, so that a movement speed of the sheet P when the sheet P is stacked on the stack portion 1*e* becomes smaller when the pressing-force changer 45 is in the second state.

Figure 4C:
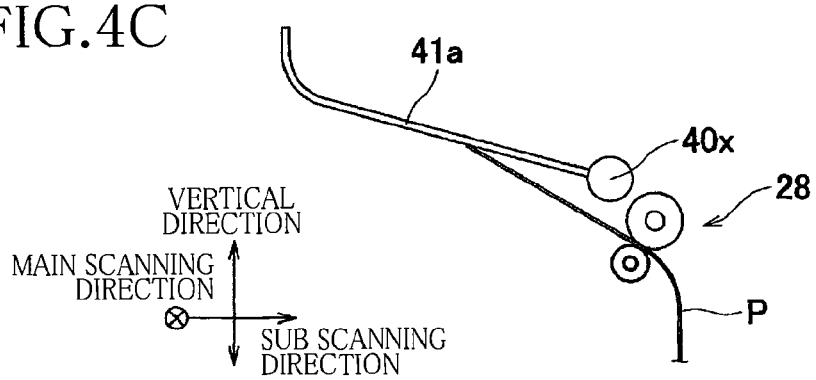
FIG. 4C is a schematic side view showing a state in which a sheet moves toward the stack portion when the pressing-force changer is in the first state and the first arm is moved from the first position to a third position.
Figure 4D:
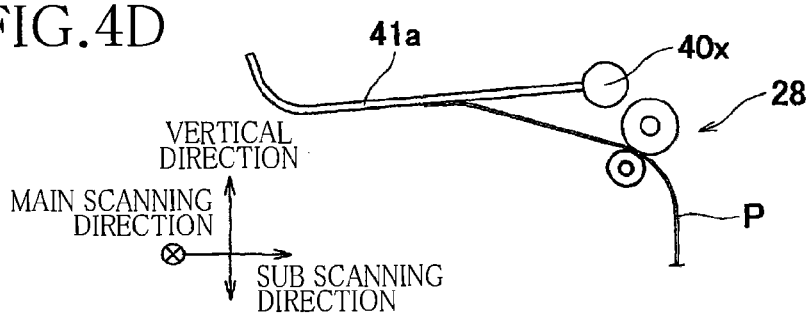
FIG. 4D is a schematic side view showing a state in which the sheet moves toward the stack portion when the pressing-force changer is in the second state and the first arm is moved from the first position to the third position.

The sheet P that has been conveyed toward the stack portion 1 while being nipped by the rollers of the roller pair 28 comes into contact with the first arm 41*a* and the pair of auxiliary arms 41*b* and lifts up the first arm 41*a* and the pair of auxiliary arms 41*b* (FIGS. 4C, 4D). On this occasion, the first arm 41*a* moves from the first position to the third position. As explained above, because the pressing force applied to the sheet P by the first arm 41*a* and the pair of auxiliary arms 41*b* is larger when the pressing-force changer 45 is in the second state (FIG. 4D) than when the pressing-force changer 45 is in the first state (FIG. 4C), the lifting amount of the first arm 41*a* and the pair of auxiliary arms 41*b* by the sheet P is smaller when the pressing-force changer 45 is in the second state. Accordingly, the third position of the first arm 41*a* is lower when the pressing-force changer 45 is in the second state (FIG. 4D) than when the pressing-force changer 45 is in the first state (FIG. 4C).

When the pressing-force changer 45 is in the first state, the sheet P that has been conveyed toward the stack portion le comes into contact with the first arm 41*a* and the pair of auxiliary arms 41*b*, lifts up these arms 41*a*, 41*b*, and subsequently moves toward the stopper 1*e*S. The sheet P then drops downward after its leading end portion (the downstream-side end portion of the sheet P in the conveyance direction) has come into contact with the stopper 1*e*S, thereafter slidingly moves on the inclined surface 1*e*1*a* or the sheets P stacked on the inclined surface 1*e*1*a*, and finally stops when the trailing end of the sheet comes into contact with the support surface 1*e*2*a*.

When the pressing-force changer 45 is in the second state, the sheet P that has been conveyed toward the stack portion 1*e* comes into contact with the first arm 41*a* and the pair of auxiliary arms 41*b*, lifts up these arms 41*a*, 41*b*, and subsequently drops downward without coming into contact with the stopper 1*e*S because the movement speed of the sheet P becomes comparatively small. Then the sheet P slidingly moves on the inclined surface 1*e*1*a* or the sheets P stacked on the inclined surface 1*e*1*a* by a distance that is smaller than that when the pressing-force changer 45 is in the first state, and stops when the trailing end of the sheet P comes into contact with the support surface 1*e*2*a*. Alternatively, the sheet P stops, immediately after dropping, with its trailing end supported by the support surface 1*e*2*a* without substantially slidingly moving.

Figure 6:
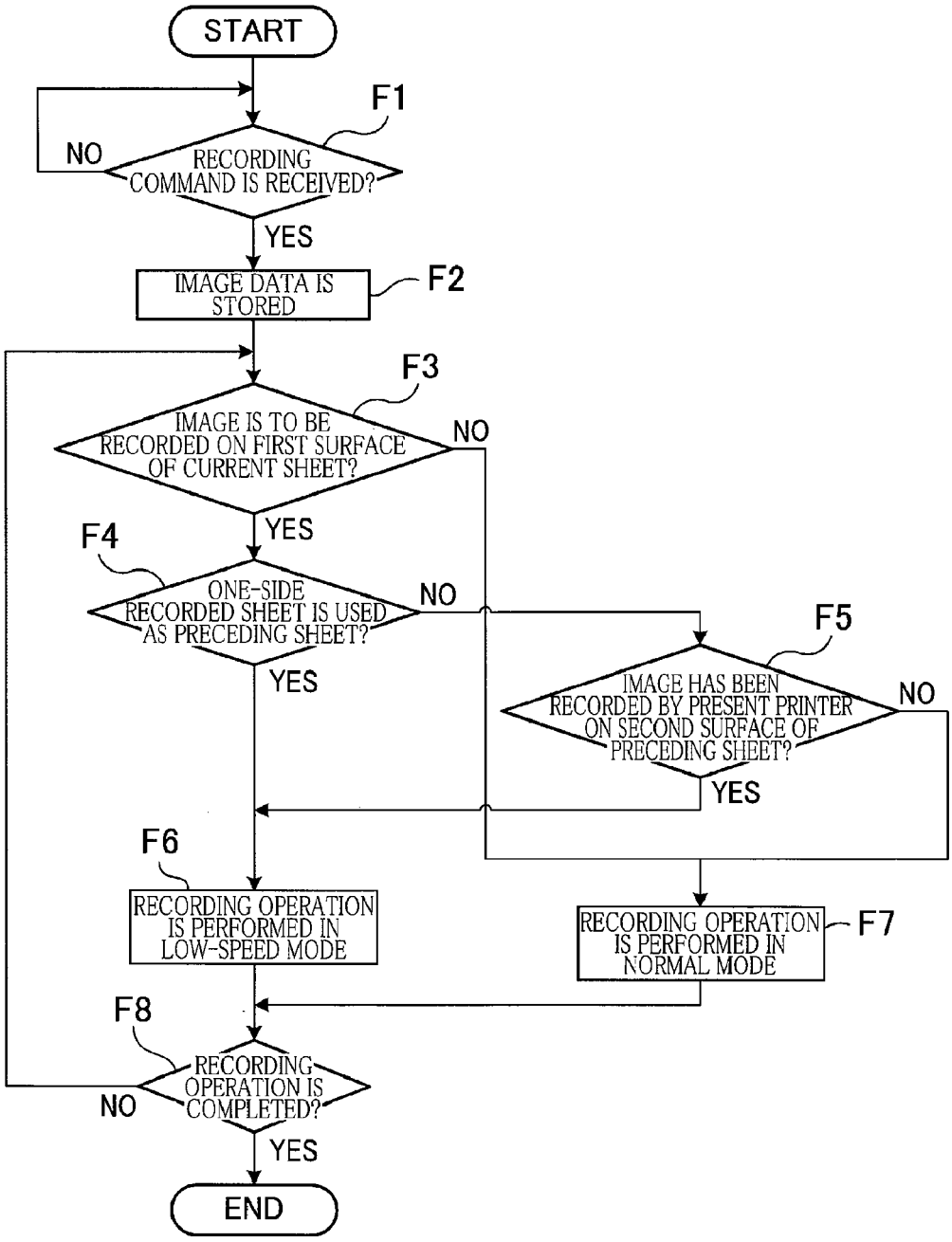
FIG. 6 is a flow chart showing details of a control executed by a controller of the printer.

Referring next to FIG. 6, there will be explained details of the control executed by the controller 100.

The controller 100 initially judges whether or not a recording command is received from the external device (F1). Where the recording command is not received (F1: NO), the controller 100 returns the processing to F1. Where the recording command is received (F1: YES), the controller 100 stores, in the RAM, information on image data contained in the recording command (F2). The controller 100 further stores, in the RAM, information that indicates single-sided recording or the duplex recording among the information contained in the recording command. The controller 100 calculates a liquid amount to be ejected to the front surface of the sheet P and a liquid amount to be ejected to the back surface of the sheet P on the basis of the image data and stores, in the RAM, data of the liquid amounts. The controller 100 keeps, in the RAM, the information on the recording command until a next recording command is received and a recording operation based on the next recording command is completed.

After F2, the controller 100 refers to the image data stored in the RAM and judges whether or not an image is to be recorded on a first surface of a current sheet P (F3). Here, "current sheet P" means a sheet P on which a recording operation for recording the image is to be performed, and "first surface" refers to a surface of the sheet P facing downward when stacked on the stack portion 1*e*. More specifically, the "first surface" is the front surface of the sheet P in the case of the single-sided recording while the "first surface" is the back surface in the case of the duplex recording. For instance, where the image data with respect to the first surface of the current sheet P is blank-sheet data, the controller 100 judges that the image is not to be recorded on the first surface of the current sheet P. Where the image is not to be recorded on the first surface of the current sheet P (F3: NO), the controller 100 moves the processing to F7.

Where the image is to be recorded on the first surface of the current sheet P (F3: YES), the controller 100 judges whether or not a preceding sheet P is a one-side recorded sheet, in other words, the one-side recorded sheet is used as the preceding sheet P (F4). Here, the "preceding sheet P" means a sheet that is subjected to the recording operation immediately before the current sheet P on the basis of the current recording command or a sheet that is lastly subjected to the recording operation on the basis of a preceding recording command that precedes the current recording command. In this respect, the current sheet P and the preceding sheet P are one example of two successive sheets P that are to be successively stacked on the stack portion le. More specifically, the current sheet P is one of the two successive sheets P that is to be later stacked on the stack portion le and the preceding sheet P is the other of the two successive sheets P that is to be earlier stacked on the stack portion 1*e*. Further, the "one-side recorded sheet" is a sheet in which any image or the like has been already recorded only on one of opposite surfaces of the sheet. In F4, the controller 100 judges whether or not an image is present on the back surface of the preceding sheet P on the basis of a reading result of the scanner 5. Where the image is present on the back surface of the preceding sheet P, the controller 100 judges that the one-side recorded sheet is used as the current sheet P, in other words, the current sheet P is the one-side recorded sheet. Where the one-side recorded sheet is used as the preceding sheet P (F4: YES), the controller 100 moves the processing to F6.

Where the one-side recorded sheet is not used as the preceding sheet P (F4: NO), the controller 100 refers to the image data stored in the RAM and judges whether or not the image has been recorded by the present printer 1 on a second surface of the preceding sheet P (F5). Here, the "second surface" refers to a surface of the sheet P facing upward when stacked on the stack portion le. More specifically, the "second surface" is the back surface of the sheet P in the case of the single-sided recording while the "second surface" is the front surface in the case of the duplex recording. Where the image has been recorded by the present printer 1 on the second surface of the preceding sheet P (F5: YES), the controller 100 moves the processing to F6. Where the image has not been recorded by the present printer 1 on the second surface of the preceding sheet P (F5: NO), the controller 100 moves the processing to F7.

The controller 100 controls various portions of the printer 1 such that the recording operation is performed in a low-speed mode in F6 and such that the recording operation is performed in a normal mode in F7. In both of F6 and F7, the controller 100 controls the conveyance operation of the sheet P by the conveyor portion 50 and the liquid ejection operation of each head 10*a*, 10*b* in synchronism with the conveyance of the sheet P, such that the image is recorded on the sheet P on the basis of the recording command received in F1.

In the low-speed mode, the rotation speed of the conveyance motor 50M is set to be lower and the pressing force of the pressing member 40 with respect to the sheet P is set to be larger, as compared with those in the normal mode. As for the pressing force, the driving by the solenoid 47 is controlled such that the pressing-force changer 45 is placed in the second state in the low-speed mode while the pressing-force changer 45 is placed in the first state in the normal mode. In the arrangement, the movement speed of the sheet P when stacked on the stack portion le is smaller in the low-speed mode than in the normal mode. Further, a distance in the conveyance direction between two successive sheets P that are successively conveyed by the conveyor portion 50 is set to be smaller in the low-speed mode than in the normal mode.

When F6 is executed, the controller 100 divides each of two mutually opposable surfaces of two successive sheets P that are to be successively stacked on the stack portion 1*e*, namely, divides each of the second surface of the preceding sheet and the first surface of the current sheet, into a plurality of regions (e.g., four regions) so as to define plural sets of two mutually opposable regions, and judges a liquid amount for at least one of the plural sets of two mutually opposable regions, on the basis of the image data contained in the recording command received in F1. The controller 100 controls the conveyor portion 50 such that the movement speed, when stacked, of one of the two successive sheets P that is to be later stacked on the stack portion 1*e* is adjusted in accordance with the liquid amount judged for the at least one of the plural sets of two mutually opposable regions. More specifically, the controller 100 controls the rotation speed of the conveyance motor 50M and the pressing force of the pressing member 40 with respect to the sheet P, such that the movement speed indicated above decreases with an increase in the liquid amount judged for the at least one of the plural sets of two mutually opposable regions. Here, the two mutually opposable surfaces of the two successive sheets P that are to be successively stacked on the stack portion 1*e* refer to two surfaces of the two successive sheets P that are opposed to each other when the two successive sheets P are stacked on the stack portion 1*e*.

While F6 or F7 is being executed, the controller 100 judges whether or not the sheets P in the maximum amount have been stacked on the stack portion 1*e*, on the basis of the signal from the sensor 43*s*. Where sheets P in the maximum amount have been stacked, the controller 100 may notify a user of the fact through an output device such as a speaker.

After F6 or F7, the controller 100 judges whether or not the recording operation is completed (F8). Where the recording operation is not yet completed (F8: NO), the controller 100 returns the processing to F3. On the other hand, where the recording operation is completed (F8: YES), the controller 100 ends the routine.

As explained above, in the present embodiment, in an instance where the two mutually opposable surfaces of the two successive sheets that are to be successively stacked on the stack portion le are both recorded surfaces on each of which the image has been recorded (in the case of F3: YES and F4: YES and in the case of F3: YES and F4: NO and F5: YES), the movement speed, when stacked, of one of the two successive sheets P that is to be later stacked on the stack portion 1*e* is made smaller by the controller 100 than in an instance where at least one of the two mutually opposable surfaces is not the recorded surface (in the case of F3: NO and in the case of F3: YES and F4: NO and F5: NO). The one of the sheets P that is to be later stacked is thus stacked on the stack portion 1*e* at a low speed, whereby the sheet P is prevented from being randomly stacked on the stack portion 1*e*, in other words, from being stacked out of place. Because the sheet P is prevented from being randomly stacked on the stack portion 1*e*, it is possible to decrease an influence of deterioration in ease of sliding (slidability or sliding characteristic) of the sheet P due to interference of convex portions formed by the liquid, such as the ink, on the recorded surfaces of the respective two successive sheets P. Therefore, it is possible to prevent deterioration in alignment of the sheets P on the stack portion 1*e*, from the viewpoint different from the water content, so that the sheets P are stacked on the stack portion 1*e* in place with edges thereof aligned with one another. Thus, the sheet alignment characteristics of the recording apparatus are ensured. In other words, where the movement speed of the sheet P when stacked on the stack portion le becomes smaller, a distance by which the sheet P moves toward the downstream side after the trailing end portion of the sheet P has passed through the roller pair 28 becomes shorter. That is, a distance by which the trailing end portion of the sheet P is away from the support surface 1*e*2*a* becomes shorter. Because the distance in question is made short, it is possible to prevent deterioration in alignment of the sheets P even if ease of sliding of the sheets P is deteriorated. On the other hand, where the distance in question is long, the influence of deterioration in ease of sliding of the sheets P becomes large, causing a risk of deterioration in alignment of the sheets P. The printer 1 may be configured such that, irrespective of the level of the movement speed of the sheet P when stacked on the stack portion 1*e*, the sheet P slides on the stack portion le or on the sheets P already discharged on the stack portion 1*e* when the sheet P in question is being discharged onto the stack portion 1*e* by the roller pair 28. Alternatively, the printer 1 may be configured such that the sheet P is discharged without sliding on the stack portion 1*e* or on the sheets P already discharged on the stack portion 1*e* when the sheet P in question is being discharged onto the stack portion 1*e* by the roller pair 28, and drops downward on the stack portion 1*e* after having come into contact with the stopper 1*e*S.

Figure 7A:
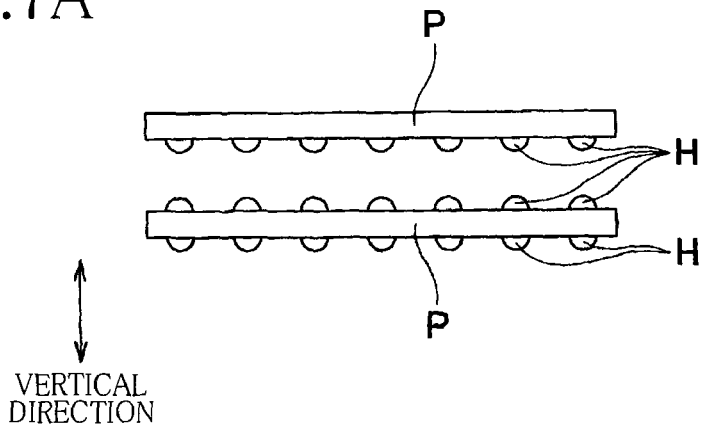
FIGS. 7A and 7B are explanatory views for explaining a phenomenon in which slidingness of the sheets is deteriorated due to interference of convex portions.
Figure 7B:
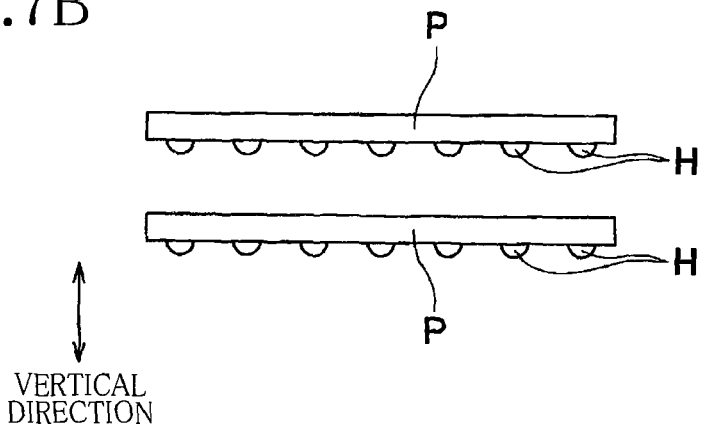

Referring to FIG. 7, there will be explained a phenomenon in which the ease of sliding of the sheets P is deteriorated due to the interference of the convex portions. When the image is recorded on the sheet P, the liquid such as a pre-treatment liquid, the ink, or the like is attached onto the sheet P. The attached liquid remains on the sheet P as minute convex portions H even after having dried. In an instance where two surfaces on each of which the convex portions H are formed are opposed to each other as shown in FIG. 7A, the convex portions H formed on the two opposable surfaces interfere with one another and a friction coefficient between the two opposable surfaces becomes large, so that the ease of sliding of the sheets P is lowered. On the other hand, in an instance where the two surfaces on each of which the convex portions H are formed are not opposed to each other as shown in FIG. 7B, the convex portions H of one of the two surfaces do not interfere with the convex portions H of the other of the two surfaces, so that the ease of sliding of the sheets P is enhanced, as compared with the instance where the two surfaces on each of which the convex portions H are formed are opposed to each other.

In the present embodiment, the rotation speed of the conveyance motor 50M is made smaller by the controller 100 in the instance where the two mutually opposable surfaces of the two successive sheets that are to be successively stacked on the stack portion 1*e* are both recorded surfaces on each of which the image has been recorded (in the case of F3: YES and F4: YES and in the case of F3: YES and F4: NO and F5: YES) than in the instance where the at least one of the two mutually opposable surfaces is not the recorded surface (in the case of F3: NO and in the case of F3: YES and F4: NO and F5: NO). In the arrangment, the rotation speed of at least the most downstream roller pair 28 that is disposed on the most downstream side in the conveyance direction among the plurality of roller pairs 22-28 is made smaller, whereby the movement speed, when stacked, of the one of the two successive sheets that is to be later stacked on the stack portion 1*e* can be made smaller with high reliability.

In the present embodiment, the controller 100 controls the pressing-force changer 45 such that the pressing force to be applied by the pressing member 40 to the one of the two successive sheets P that is to be later stacked on the stack portion 1*e* is made larger in the instance where the two mutually opposable surfaces of the two successive sheets that are to be successively stacked on the stack portion 1*e* are both recorded surfaces (in the case of F3: YES and F4: YES and in the case of F3: YES and F4: NO and F5: YES) than in the instance where the at least one of the two mutually opposable surfaces is not the recorded surface (in the case of F3: NO and in the case of F3: YES and F4: NO and F5: NO). The pressing force applied by the pressing member 40 is thus made larger, whereby the movement speed, when stacked, of the one of the two successive sheets that is to be later stacked on the stack portion 1*e* can be made smaller with high reliability.

In the present embodiment, the controller 100 controls the solenoid 47 such that the distance between the support member 46 and the second arm 42 at a time when the one of the two successive sheets that is to be later stacked on the stack portion 1*e* is stacked is made larger in the instance where the two mutually opposable surfaces of the two successive sheets that are to be successively stacked on the stack portion 1*e* are both recorded surfaces (in the case of F3: YES and F4: YES and in the case of F3: YES and F4: NO and F5: YES) than in the instance where the at least one of the two mutually opposable surfaces is not the recorded surface (in the case of F3: NO and in the case of F3: YES and F4: NO and F5: NO). The distance is thus made larger, so that the spring 45*s* is expanded. As a result, the pressing force applied by the pressing member 40 can be made larger with high reliability owing to the force of the spring 45*s* to return to its original shape, namely, owing to resilience of the spring 45*s*. In other words, the above-indicated distance is changed such that the pressing force becomes larger.

The first arm 41*a* is configured to pivot in accordance with the amount of the sheets P stacked on the stack portion 1*e*. The controller 100 is configured to judge whether or not the sheets P in the maximum amount have been stacked on the stack portion 1*e* on the basis of the signal from the sensor 43*s*, namely, on the basis of the positions of the third arm 43 and the first arm 41*a*. Thus, the movement speed indicated above can be made smaller utilizing the first arm 41*a* that is utilized in judging the amount of the sheets P stacked on the stack portion le. Therefore, there is no need to provide additional members or components for reducing the movement speed, resulting in simplification of the structure of the apparatus.

The controller 100 judges whether or not the image is present only on one surface of the preceding sheet P (F4, F5). Where it is judged that the image is present on both surfaces of the preceding sheet P (in the case of F4: YES and in the case of F4: NO and F5: YES), the controller 100 judges that the two mutually opposable surfaces of the two successive sheets that are to be successively stacked on the stack portion le are both recorded surfaces. On the other hand, where it is judged that the image is present only on one surface of the preceding sheet P (in the case of F4: NO and F5: NO), the controller 100 judges that at least one of the two mutually opposable surfaces of the two successive sheets is not the recorded surface. Thus, in the present embodiment, it is possible to easily judge whether or not the two mutually opposable surfaces of the two successive sheets that are to be successively stacked on the stack portion 1*e* are both recorded surfaces, depending upon whether the image is present only on one surface of the preceding sheet P or the image is present on both surfaces of the preceding sheet P.

In judging whether the image is present only on one surface of the preceding sheet P or the image is present on both surfaces of the preceding sheet P, the controller 100 judges whether or not the one-side recorded sheet is used as the preceding sheet P, on the basis of a reading result of the scanner 5 (F4). Where a sheet in which the image has been already recorded on its back surface (i.e., already recorded sheet or one-side recorded sheet) is used even if the single-sided recording is instructed to be performed on the preceding sheet P by a user, the two mutually opposable surfaces of the two successive sheets that are to be successively stacked on the stack portion 1*e* are to be both the recorded surfaces. In view of this, the controller 100 judges that the image is present on both surfaces of the preceding sheet P where it is judged on the basis of the reading result of the scanner 5 that the one-side recorded sheet is used as the preceding sheet P (F4: YES) even if the single-sided recording was instructed to be performed by the user. Accordingly, it is possible to prevent, with higher reliability, deterioration in alignment of the sheets P on the stack portion 1*eb*, namely, deterioration in sheet alignment characteristics of the recording apparatus.

In the present embodiment, the distance in the conveyance direction between the two successive sheets that are successively conveyed by the conveyor portion 50 is made smaller by the controller 100 in the instance where the two mutually opposable surfaces of the two successive sheets that are to be successively stacked on the stack portion 1*e* are both recorded surfaces (in the case of F3: YES and F4: YES and in the case of F3: YES and F4: NO and F5: YES) than in the instance where the at least one of the two mutually opposable surfaces is not the recorded surface (in the case of F3: NO and in the case of F3: YES and F4: NO and F5: NO). The arrangement prevents a reduction in the speed of the recording operation as a whole, even where the above-indicated movement speed is made smaller.

In the present embodiment, in the instance where the two mutually opposable surfaces of the two successive sheets that are to be successively stacked on the stack portion 1*e* are both recorded surfaces (in the case of F3: YES and F4: YES and in the case of F3: YES and F4: NO and F5: YES), the controller 100 judges the liquid amount of each of the two mutually opposable surfaces and controls the conveyor portion 50 such that the above-indicated movement speed is adjusted depending upon the judged liquid amounts. Accordingly, it is possible to prevent, with higher reliability, deterioration in alignment of the sheets P on the stack portion 1*eb*, namely, deterioration in sheet alignment characteristics of the recording apparatus.

In the arrangement described just above, the controller 100 divides each of the two mutually opposable surfaces into a plurality of regions so as to define plural sets of two mutually opposable regions, and judges the liquid amount for at least one of the plural sets of two mutually opposable regions. Accordingly, it is possible to prevent, with higher reliability, deterioration in alignment of the sheets P on the stack portion 1*eb*, namely, deterioration in sheet alignment characteristics of the recording apparatus.

The stack portion 1*e* includes: the inclined surface 1*e*1*a* that is inclined relative to the horizontal plane such that the height of the inclined surface 1*e* la as measured from the horizontal plane increases toward the downstream side in the movement direction of the sheet P in which the sheet P moves when stacked on the stack portion 1*e;* and the support surface 1*e*2*a* configured to support the trailing end portion of the sheet P on the upstream side of the inclined surface 1*e*1*a* in the movement direction described above. According to the arrangement, the sheet P slidingly moves along the inclined surface 1*e*1*a*, and thereafter the sheet P stops when the trailing end portion thereof comes into contact with the support surface 1*e*2*a*. In such a structure, alignment of the sheets P tends to be adversely influenced by deteriorated ease of sliding due to interference of the convex portions described above. In the present invention, however, the adverse influence can be mitigated and the deterioration in alignment of the sheets P can be suppressed.

Figure 8:
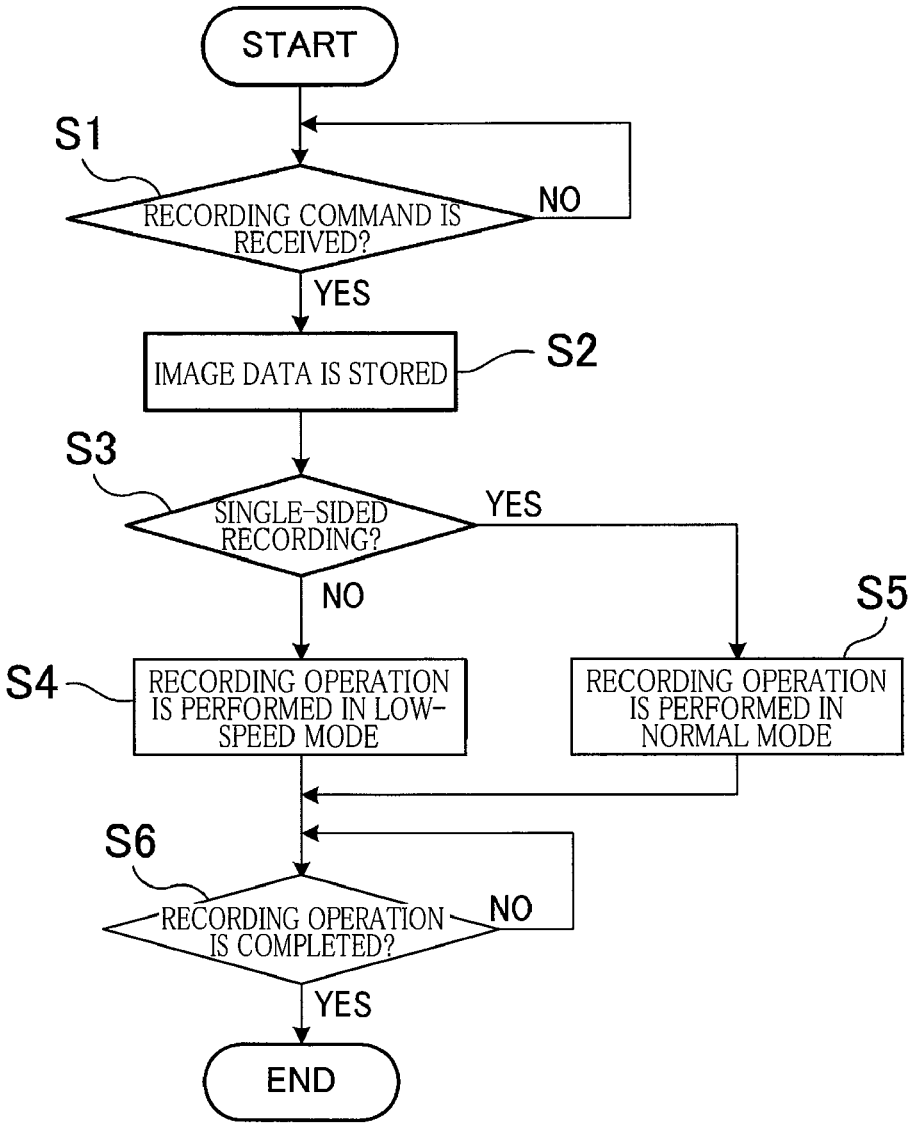
FIG. 8 is a flow chart showing details of a control executed by a controller of an ink-jet printer according to a second embodiment of the invention.

Referring next to FIG. 8, there will be explained details of the control to be executed by a controller 100 of an ink-jet printer according to a second embodiment of the invention.

The printer of the second embodiment is identical in construction with the printer 1 of the first embodiment except for control details executed by the controller 100.

The controller 100 initially judges whether or not a recording command is received from the external device (S1). Where the recording command is not received (S1: NO), the controller 100 returns the processing to S1. Where the recording command is received (S1: YES), the controller 100 stores, in the RAM, information on image data contained in the recording command (S2).

After S2, the controller 100 refers to the image data stored in the RAM and judges whether or not the recording operation to be performed is the single-sided recording (S3). In this instance, the controller 100 judges whether or not the recording operation is the single-sided recording for all of the sheets P on each of which the recording operation is to be performed based on the recording command received in S1. Where the recording operation is not the single-sided recording (S3: NO), namely, where the recording operation is the duplex recording, the controller 100 moves the processing to S4. Where the recording operation is the single-sided recording (S3: YES), the controller 100 moves the processing to S5.

The controller 100 controls various portions of the printer 1 such that the recording operation is performed in the low-speed mode in S4 and such that the recording operation is performed in the normal mode in S5. In both of S4 and S5, the controller 100 controls the conveyance operation of the sheet P by the conveyor portion 50 and the liquid ejection operation of each head 10*a*, 10*b* in synchronism with the conveyance of the sheet P, such that the image is recorded on the sheet P on the basis of the recording command received in S1.

As in the illustrated first embodiment, in the low-speed mode, the rotation speed of the conveyance motor 50M is set to be lower and the pressing force of the pressing member 40 with respect to the sheet P is set to be larger, as compared with those in the normal mode. Further, the distance in the conveyance direction between the two successive sheets P that are successively conveyed by the conveyor portion 50 is set to be smaller in the low-speed mode than in the normal mode. When S4 is executed, the controller 100 divides each of the two mutually opposable surfaces of the two successive sheets P that are to be stacked on the stack portion 1*e* into a plurality of regions (e.g., four regions) so as to define plural sets of two mutually opposable regions, and judges the liquid amount for at least one of the plural sets of two mutually opposable regions, on the basis of the image data contained in the recording command received in S1. The controller 100 controls the conveyor portion 50 such that the movement speed, when stacked, of one of the two successive sheets P that is to be later stacked on the stack portion 1*e* is adjusted in accordance with the liquid amount judged for the at least one of the plural sets of two mutually opposable regions. More specifically, the controller 100 controls the rotation speed of the conveyance motor 50M and the pressing force of the pressing member 40 with respect to the sheet P, such that the movement speed indicated above decreases with an increase in the liquid amount judged for the at least one of the plural sets of two mutually opposable regions. While S4 or S5 is being executed, the controller 100 judges whether or not the sheets P in the maximum amount have been stacked on the stack portion 1*e*, on the basis of the signal from the sensor 43*s*. Where the sheets P in the maximum amount have been stacked on the stack portion 1*e*, the controller 100 may notify a user of the fact through an output device such as a speaker.

After S4 or S5, the controller 100 judges whether or not the recording operation is completed (S6). Where the recording operation is not yet completed (S6: NO), the controller 100 repeats the processing. On the other hand, where the recording operation is completed (S6: YES), the controller 100 ends the routine.

As explained above, in the present embodiment, in the instance where the two mutually opposable surfaces of the two successive sheets P that are to be successively stacked on the stack portion 1*e* are both recorded surfaces (in the case of S3: NO), the movement speed of one of the two successive sheets P that is to be later stacked on the stack portion 1*e* is made smaller by the controller 100 than in the instance where the at least one of the two mutually opposable surfaces is not the recorded surface (in the case of S3: YES). Therefore, as in the illustrated first embodiment, it is possible to prevent deterioration in alignment of the sheets P on the stack portion 1*e*, from the viewpoint different from the water content, so that the sheets P are stacked on the stack portion 1*e* in place with edges thereof aligned with one another. Thus, the sheet alignment characteristics of the recording apparatus are ensured.

The controller 100 judges whether or not the recording operation is the single-sided recording (S3). Where it is judged that the recording operation is not the single-sided recording, namely, where it is judged that the recording operation is the duplex recording (S3: NO), the controller 100 judges that the two mutually opposable surfaces of any two successive sheets P that are to be successively stacked on the stack portion 1*e* are both the recorded surfaces. On the other hand, where it is judged that the recording operation is the single-sided recording (S3: YES), the controller 100 judges that the at least one of the two mutually opposable surfaces of any two successive sheets P is not the recorded surface. Thus, in the second embodiment, it is possible to easily judge whether or not the two mutually opposable surfaces of the two successive sheets P that are to be successively stacked on the stack portion 1*e* are both the recorded surfaces, depending upon whether the recording operation is the duplex recording or the single-sided recording. In the first embodiment, the presence or absence of the image is judged for each of the sheets P (each of the current sheet and the preceding sheet) and accordingly the control details are complicated. In contrast, in the second embodiment, it is simply judged whether or not the recording operation is the single-sided recording for all of the sheets P on each of which the recording operation is performed on the basis of the recording command, thereby simplifying the control details.

In addition, the second embodiment offers advantages similar to those in the first embodiment owing to the structure similar to that in the first embodiment.

In the recording operation, a treatment liquid is selectively ejected to the sheet P, namely, there is an instance in which a treatment liquid is ejected to the sheet P and there is an instance in which the treatment liquid is not ejected to the sheet P. A treatment liquid having a function of coagulating pigments is used for pigment ink, and a treatment liquid having a function of precipitating dyes is used for dye ink. The treatment liquid may be formed of any suitable liquid such as liquid containing a cationic high polymer, a polyvalent metal salt such as a magnesium salt, or the like. In the instance in which the treatment liquid is ejected, the total amount of the liquid (the pre-treatment liquid the black ink) attached onto the sheet P is larger than in the instance in which the treatment liquid is not ejected. Accordingly, it is conjectured that the sheet P is less likely to dry and the convex portions formed on the recorded surface become large due to the component of the coagulated or precipitated ink, resulting in deterioration in ease of sliding and alignment of the sheets P. In view of this, in the first and second embodiments, the rotation speed of the conveyance motor 50M and the pressing force applied from the pressing member 40 to the sheet P are controlled, to thereby adjust the movement speed of the sheet P when stacked on the stack portion 1*e* as follows. That is, the movement speed of one of the two successive sheets P that is to be later stacked on the stack portion 1*e* is set to be V1 in an instance where the at least one of the two mutually opposable surfaces of the two successive sheets that are to be successively stacked on the stack portion 1*e* is not the recorded surface (in the case of F3: NO and in the case of F3: YES and F4: NO and F5: NO, in the first embodiment, and in the case of S3: YES in the second embodiment). The movement speed is set to be V2 in an instance where the two mutually opposable surfaces are both recorded surfaces (in the case of F3: YES and F4: YES and in the case of F3: YES and F4: NO and F5: YES, in the first embodiment, and in the case of S3: NO in the second embodiment) and the treatment liquid is not ejected. The movement speed is set to be V3 in an instance where the two mutually opposable surfaces are both recorded surfaces and the treatment liquid is ejected. Here, the above-indicated speeds V1-V3 have a relationship represented as V1>V2>V3. The arrangement is capable of suppressing deterioration in alignment of the sheets P with higher reliability.

As the ink, there are known pigment ink containing a pigment and dye ink containing a dye. In general, particles of the pigment tend to remain on the recorded surface ink, as compared with particles of the dye ink. In a case in which the pigment ink is used, the sheet P is less likely to dry and the convex portions formed on the recorded surface become large, as compared with a case in which the dye ink is used. Accordingly, it is conjectured that ease of sliding and alignment of the sheets P are deteriorated. In view of this, in a printer having a head configured to eject color ink, in addition to the head 10*b* configured to eject the black ink, the above-indicated movement speed of the sheet P when stacked is adjusted as follows according to a first modified example of the first and second embodiments where the black ink is pigment ink and the color ink is dye ink. More specifically, in the first modified example, the movement speed of the one of the two successive sheets that is to be later stacked on the stack portion 1*e* is adjusted as follows by controlling the rotation speed of the conveyance motor 50M and the pressing force applied by the pressing member 40 to the sheet P. That is, the movement speed is set to be V1' in an instance where at least one of the two mutually opposable surfaces of the two successive sheets that are to be successively stacked on the stack portion 1*e* are not the recorded surface (in the case of F3: NO and in the case of F3: YES and F4: NO and F5: NO, in the first embodiment, and in the case of S3: YES in the second embodiment). The movement speed is set to be V2' in an instance where the two mutually opposable surfaces are both the recorded surfaces (in the case of F3: YES and F4: YES and in the case of F3: YES and F4: NO and F5: YES, in the first embodiment, and in the case of S3: NO in the second embodiment) and the black ink is not ejected while the color ink is ejected. The movement speed is set to be V3' in an instance where the two mutually opposable surfaces are both the recorded surfaces and the black ink is ejected. Here, the above-indicated speeds V1'-V3' have a relationship represented as V1'>V2'>V3'. The arrangement is capable of suppressing deterioration in alignment of the sheets P with higher reliability.

With an increase in an amount of a penetrating agent contained in the ink, an amount of the ink that penetrates into the sheet P increases, whereby the liquid amount remaining on the sheet P decreases and the convex portions formed on the recorded surface become small. It is accordingly conjectured that ease of sliding and alignment of the sheets P will be improved. In view of this, in a printer having a head configured to eject color ink, in addition to the head 10*b* configured to eject the black ink, the above-indicated movement speed is adjusted as follows according to a second modified example of the first and second embodiments where the amount of the penetrating agent contained in the black ink is smaller than that in the color ink. More specifically, in the second modified example, the movement speed of the one of the two successive sheets that is to be later stacked on the stack portion 1*e* is adjusted as follows by controlling the rotation speed of the conveyance motor 50M and the pressing force applied by the pressing member 40 to the sheet P. That is, the movement speed is set to be V1" in an instance where at least one of the two mutually opposable surfaces of the two successive sheets that are to be successively stacked on the stack portion 1*e* are not the recorded surface (in the case of F3: NO and in the case of F3: YES and F4: NO and F5: NO, in the first embodiment, and in the case of S3: YES in the second embodiment). The movement speed is set to be V2" in an instance where the two mutually opposable surfaces are both the recorded surfaces (in the case of F3: YES and F4: YES and in the case of F3: YES and F4: NO and F5: YES, in the first embodiment, and in the case of S3: NO in the second embodiment) and the black ink is not ejected while the color ink is ejected. The movement speed is set to be V3" in an instance where the two mutually opposable surfaces are both the recorded surfaces and the black ink is ejected. Here, the above-indicated speeds V1"-V3" have a relationship represented as V1">V2">V3". The arrangement is capable of suppressing deterioration in alignment of the sheets P with higher reliability.

Figure 9:
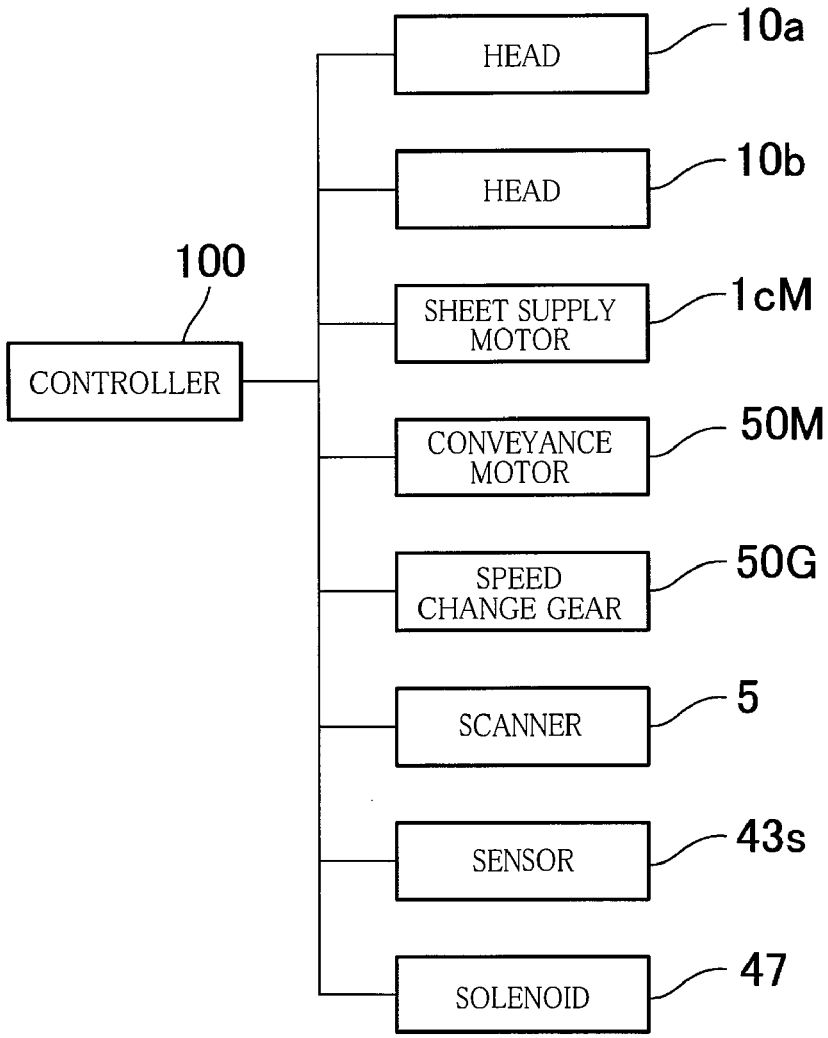
FIG. 9 is a block diagram showing an electric structure of an ink-jet printer according to a third embodiment of the invention.

Referring next to FIG. 9, there will be explained an ink-jet printer according to a third embodiment of the invention.

The printer in the third embodiment is identical in construction with the printer 1 of the first embodiment except that a speed change gear 50G is provided for the roller pairs 27, 28.

According to the third embodiment, in the low-speed mode, the rotation speed of the conveyance motor 50M is set to be equal to that in the normal mode, and the rotation speeds of the rollers of the respective roller pairs 27, 28 are made smaller than those in the normal mode by controlling the speed change gear 50G. The third embodiment offers advantages similar to those in the illustrated first embodiment and the following additional advantage. That is, according to the third embodiment, the conveyance speed of the sheet P after having passed each recording position is reduced without reducing the conveyance speed of the sheet P at each recording position, thereby avoiding the control of the heads 10*a*, 10*b* from being complicated.

Figure 10:
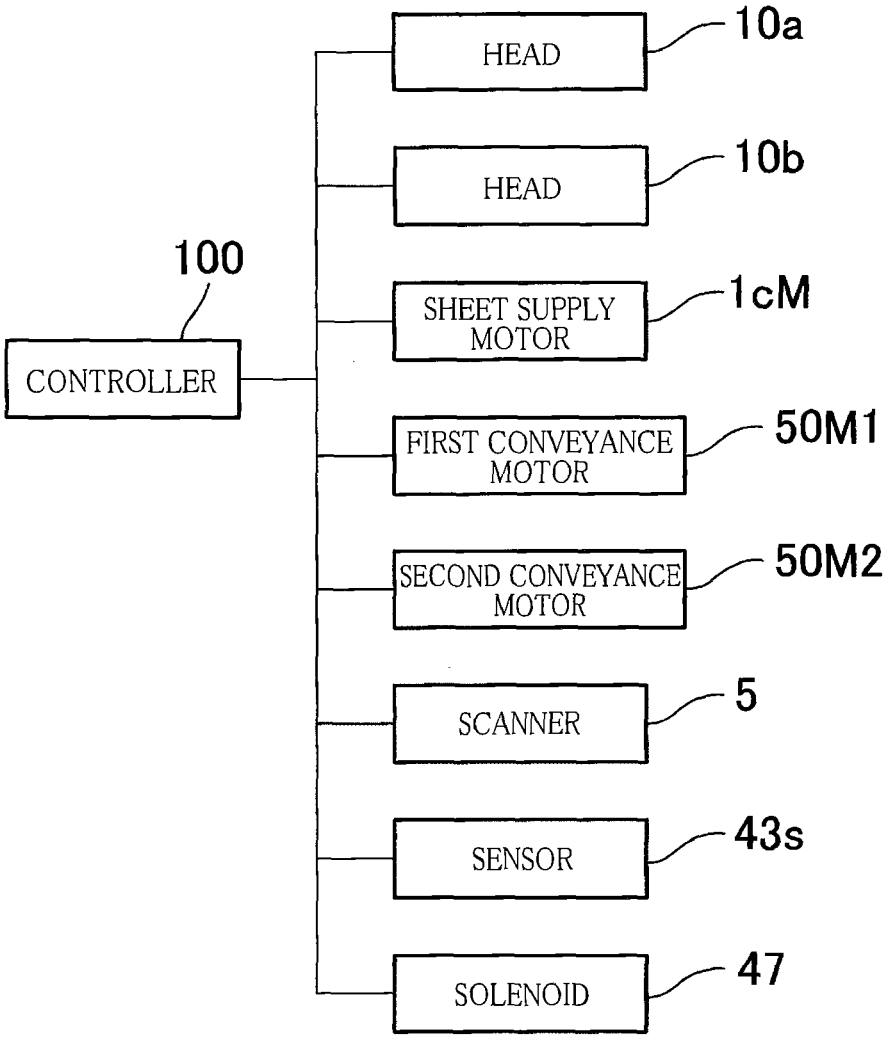
FIG. 10 is a block diagram showing an electric structure of an ink-jet printer according to a fourth embodiment of the invention.

Referring next to FIG. 10, there will be explained an ink-jet printer according to a fourth embodiment of the invention.

The printer in the fourth embodiment is identical in construction with the printer 1 of the first embodiment except that, in place of the conveyance motor 50M, there are provided a first conveyance motor 50M1 connected to the drive roller of each of the roller pairs 22-26, 96, 97 and a second conveyance motor 50M2 connected to the drive roller of each of the roller pairs 27, 28.

According to the fourth embodiment, in the low-speed mode, the rotation speed of the first conveyance motor 50M1 is set to be equal to that in the normal mode, and the rotation speed of the second conveyance motor 50M2 is made smaller than that in the normal mode. The fourth embodiment offers advantages similar to those in the third embodiment, namely, offers the advantages similar to those in the first embodiment and the advantage of avoiding the control of the heads 10*a*, 10*b* from being complicated.

While the embodiments of the invention have been explained, it is to be understood that the present invention is not limited to the details of the illustrated embodiments, but may be embodied with other changes and modifications without departing from the scope of the invention defined in the attached claims.

The controller may be configured such that the distance in the conveyance direction of the two successive sheets that are successively conveyed by the conveyor portion is not made smaller in the instance where the two mutually opposable surfaces of the two successive sheets that are to be successively stacked on the stack portion are both the recorded surfaces than in the instance where the at least one of the two mutually opposable surfaces is the recorded surface.

The controller may be configured to reduce the movement speed, when stacked, of the one of the two successive sheets that is to be later stacked on the stack portion by one of reducing the roller rotation speeds and increasing the pressing force applied by the pressing member to the sheet, or by any arbitrary method, in the instance where the two mutually opposable surfaces of the two successive sheets that are to be successively stacked on the stack portion are both the recorded surfaces, as compared with the instance where the at least one of the two mutually opposable surfaces is the recorded surface.

The controller may be configured to judge not only whether or not the amount of the sheets stacked on the stack portion is the maximum amount, but also the amount of the sheets stacked on the stack portion, on the basis of the signal from the sensor.

The structure of the pressing member is not limited to that in the illustrated embodiments, as long as the pressing member is capable of pressing the sheet toward the stack portion. For instance, the first arm may be configured not to pivot in accordance with the amount of the sheets stacked on the stack portion and not to be utilized in judging the amount of the sheets stacked on the stack portion.

A user may input information as to whether the already recorded sheet, i.e., the one-side recorded sheet, is used or not. In this instance, the controller is capable of judging, not on the basis of the reading result of the image reading portion, but only on the basis of the input by the user, whether the single-sided recording was performed on the preceding sheet and the one-side recorded sheet was used as the preceding sheet, whether the single-sided recording was performed on the preceding sheet and the one-side recorded sheet was not used as the preceding sheet, and whether the duplex recording was performed on the preceding sheet. The controller may be configured to reduce the movement speed of the sheet when stacked on the stack portion in an instance where the single-sided recording was performed on the preceding sheet and the one-side recorded sheet was used as the preceding sheet and in an instance where the duplex recording was performed on the preceding sheet. The controller may be configured not to consider whether or not the already recorded sheet, i.e., the one-side recorded sheet, is used.

The image reading portion may be disposed at an arbitrary position. For instance, in the first embodiment, the image reading portion may be disposed between the roller pair 24 and the platen 60 that is opposed to the head 10*a*. The image reading portion may be omitted.

The controller may be configured to judge the amount of the liquid (recording agent) of the entirety of each of the two mutually opposable surfaces, without dividing each surface into a plurality of regions. It is not essential to adjust the movement speed in accordance with the amounts of the liquid (recording agent) of both of the two mutually opposable surfaces.

The conveyor portion is not limited to the roller-type conveyor system illustrated above, but may be a belt-type conveyor system, for instance. Further, it is not essential for the conveyor portion to have the pressing member and the pressing-force changer.

The stack portion may be provided at a side portion of the casing of the recording apparatus, other than the top plate of the casing of the recording apparatus. Further, it is not essential for the stack portion to have the inclined surface and the support surface illustrated above. For instance, the stack portion may be configured to support the sheet by or on the surface extending in the horizontal direction.

The recording portions may be provided in the recording apparatus by any arbitrary number equal to or larger than one. Each recording portions may eject any arbitrary liquid other than the pre-treatment liquid and the ink. Each recording portion is not limited to the one configured to eject the liquid, namely, not limited to the ink-jet type illustrated above. For instance, the recording portion may be configured to form an electric latent image on a photosensitive body by irradiating the charged photosensitive body with a laser light or the like so as to transfer the latent image onto the recording medium (laser type). Further the recording portion may be configured to thermally transfer ink coated on a tape to the recording medium (thermal transfer type). The present invention is applicable to the laser type, for instance, because convex portions composed of a toner as the recording agent are formed on a recorded surface of the recording medium recorded by the laser-type recording portion.

The recording medium is not limited to the sheets P, but may be any arbitrary recordable media.

The present invention is applicable to not only the printer, but also a facsimile machine, a copying machine, and the like.

What is claimed is:

1. A recording apparatus, comprising:

a recording portion configured to perform a recording operation to record an image on each of recording media;

a stack portion on which the recording media on each of which the image has been recorded by the recording portion are stacked;

a conveyor portion configured to convey each of the recording media from a recording position at which the image is recorded on said each of the recording media by the recording portion toward the stack portion; and a controller configured to control the recording apparatus, wherein the controller is configured to control the conveyor portion such that, in an instance where two mutually opposable surfaces of two successive recording media among the recording media that are to be successively stacked on the stack portion are both image-recorded surfaces on each of which an image has been recorded, a movement speed, when stacked, of one of the two successive recording media that is to be later stacked on the stack portion is made smaller, as compared with an instance where at least one of the two mutually opposable surfaces is not the image-recorded surface, and wherein the controller is configured to judge an amount of a recording agent on each of the two mutually opposable surfaces and to control the conveyor portion such that the movement speed of the one of the two successive recording media that is to be later stacked on the stack portion is adjusted in accordance with the judged amount of the recording agent, in the instance where the two mutually opposable surfaces are both the imaged-surfaces.

2. The recording apparatus according to claim 1, wherein the conveyor portion includes: a plurality of rollers disposed along a passage in which said each of the recording media is conveyed; and a drive source for driving the plurality of rollers, wherein the controller is configured to control the drive source such that a rotation speed of at least the most downstream one of the plurality rollers is made smaller in the instance where the two mutually opposable surfaces are both the image-recorded surfaces than in the instance where the at least one of the two mutually opposable surfaces is not the image-recorded surface, the most downstream one of the plurality of rollers being disposed on the most downstream side in a conveyance direction in which said each of the recording media is conveyed, among the plurality of rollers.

3. The recording apparatus according to claim 1, wherein the conveyor portion includes: a plurality of rollers disposed along a passage in which said each of the recording media is conveyed; a drive source for driving the plurality of rollers; a pressing member configured to press, toward the stack portion, the recording medium that is being conveyed by the most downstream one of the plurality of rollers; and a pressing-force changer configured to change a pressing force to be applied by the pressing member to the recording medium, and wherein the controller is configured to control the pressing-force changer such that the pressing force to be applied to the one of the two successive recording media that is to be later stacked on the stack portion is made larger in the instance where the two mutually opposable surfaces are both the image-recorded surfaces than in the instance where the at least one of the two mutually opposable surfaces is not the image-recorded surface.

4. The recording apparatus according to claim 3, wherein the pressing member includes: a shaft extending in a direction that intersects a conveyance direction in which said each of the recording media is conveyed; a first arm that protrudes from the shaft so as to be pivotable about the shaft and that is to come into contact with the recording medium being conveyed by the most downstream one of the plurality rollers; and a second arm that protrudes from the shaft so as to be pivotable about the shaft together with the first arm, wherein the pressing-force changer includes: a spring attached at one end thereof to the second arm; a support member supporting another end of the spring and connected to the second arm via the spring; and a distance change mechanism configured to change a distance between the support member and the second arm so as to change the pressing force, and wherein the controller is configured to control the distance change mechanism to change the distance at a time when the one of the two successive recording media that is to be later stacked on the stack portion is stacked such that the pressing force is made larger in the instance where the two mutually opposable surfaces are both the image-recorded surfaces than in the instance where the at least one of the two mutually opposable surfaces is not the image-recorded surface.

5. The recording apparatus according to claim 4, wherein the first arm is configured to pivot in accordance with an amount of the recording media stacked on the stack portion, wherein the pressing member further includes a third arm that protrudes from the shaft so as to be pivotable about the shaft together with the first arm, wherein the recording apparatus further includes a sensor configured to output a signal in accordance with a position of the third arm, and, wherein the controller is configured to judge the amount of the recording media stacked on the stack portion, based on the signal from the sensor.

6. The recording apparatus according to claim 1, wherein each of the recording media has a first surface and a second surface opposite to the first surface, and wherein the controller is configured to judge that the two mutually opposable surfaces of the two successive recording media are both the image-recorded surfaces where the recording operation performed by the recording portion on the other of the two successive recording media that is earlier stacked on the stack portion is duplex recording in which the image is recorded respectively on the first surface and the second surface of the other of the two successive recording media and to judge that the at least one of the two mutually opposable surfaces is not the image-recorded surface where the recording operation performed by the recording portion on the other of the two successive recording media is single-sided recording in which the image is recorded on one of the first surface and the second surface of the other of the two successive recording media.

7. The recording apparatus according to claim 1, further comprising an image reading portion configured to read an image on one surface of said each of the recording media opposite to the other surface thereof that is to be opposed to the recording portion, wherein the controller is configured to judge, based on a reading result by the image reading portion, that the two mutually opposable surfaces of the two successive recording media are both the image-recorded surfaces where the image is present on the one surface of the other of the two successive recording media that is to be earlier stacked and to judge, based on the reading result by the image reading portion, that the at least one of the two mutually opposable surfaces is not the image-recorded surface where the image is not present on the one surface of the other of the two successive recording media that is earlier stacked.

8. The recording apparatus according to claim 1, wherein the controller is configured to reduce a distance in a conveyance direction between the two successive recording media that are successively conveyed by the conveyor portion in the instance where the two mutually opposable surfaces are both the image-recorded surfaces than in the instance where the at least one of the two mutually opposable surfaces is not the image-recorded surface.

9. The recording apparatus according to claim 1, wherein the controller is configured to divide each of the two mutually opposable surfaces into a plurality of regions so as to define plural sets of two mutually opposable regions and to judge the amount of the recording agent for at least one of the plural sets of two mutually opposable regions, and wherein the controller is configured to control the conveyor portion such that the movement speed of the one of the two successive recording media that is to be later stacked on the stack portion is adjusted in accordance with the amount of the recording agent judged for the at least one of the plural sets of two mutually opposable regions.

10. The recording apparatus according to claim 1, wherein the stack portion includes: an inclined surface formed so as to be inclined relative to a horizontal plane such that a height of the inclined surface increases toward a downstream side in a movement direction of said each of the recording media in which said each of the recording media moves when stacked on the stack portion; and a support surface configured to support a trailing end of said each of the recording media on an upstream side of the inclined surface in the movement direction.

11. A recording apparatus, comprising:

a recording portion configured to perform a recording operation to record an image on each of recording media;

a stack portion on which the recording media on each of which the image has been recorded by the recording portion are stacked;

a conveyor portion configured to convey each of the recording media from a recording position at which the image is recorded on said each of the recording media by the recording portion toward the stack portion; and a controller configured to control the recording apparatus, wherein the controller is configured to control the conveyor portion such that, in an instance where two mutually opposable surfaces of two successive recording media among the recording media that are to be successively stacked on the stack portion are both image-recorded surfaces on each of which an image has been recorded, a movement speed, when stacked, of the one of the two successive recording media that is to be later stacked on the stack portion is adjusted in accordance with an amount of the recording agent on each of the two mutually opposable surfaces.

* * * * *